United States Patent [19]

Price

[11] 4,211,176

[45] Jul. 8, 1980

[54] KNIFE BLOCK FOR TUFTING MACHINES

[75] Inventor: Herbert B. Price, Hixson, Tenn.

[73] Assignee: Spencer Wright Industries, Inc., Chattanooga, Tenn.

[21] Appl. No.: 960,734

[22] Filed: Nov. 15, 1978

[51] Int. Cl.[2] ..... D05C 15/00

[52] U.S. Cl. ..... 112/79 R

[58] Field of Search ..... 112/79 R, 79 A, 79.5; 83/700

[56] References Cited

U.S. PATENT DOCUMENTS

| | | | |
|---|---|---|---|
| 3,084,644 | 4/1963 | Card | 112/79 R |
| 3,277,852 | 10/1966 | Card | 112/79 R |
| 3,386,398 | 6/1968 | Cobble et al. | 112/77 |
| 3,635,177 | 1/1972 | Gable et al. | 112/79 R |
| 3,757,709 | 9/1973 | Cobble | 83/700 X |
| 3,788,245 | 1/1974 | Bonner | 83/700 X |
| 4,061,095 | 12/1977 | Price | 83/200 X |

*Primary Examiner*—Ronald Feidbaum

*Attorney, Agent, or Firm*—Alan Ruderman

[57] ABSTRACT

A knife block for mounting four knives in staggered needle fine gauge tufting machines having a pair of dovetail shaped inserts slidably received within a pair of dovetail shaped cavities formed on opposite sides of a central web in a block body member. The inserts include a pair of rectangular grooves sized to receive tufting knives. One groove cooperates with the web to form a knife receiving channel and the other groove, which is laterally offset from the first grove by the machine stagger, is undercut from the outer face of the insert to provide another knife receiving channel. A clamping member locks both outer knives in the channels, and screw members lock each of the inner knives in the respective channels.

6 Claims, 5 Drawing Figures

KNIFE BLOCK FOR TUFTING MACHINES

BACKGROUND OF THE INVENTION

This invention relates generally to tufting machines for forming fine gauge cut pile fabric and more particularly to improved knife blocks for mounting the knives in such machines, especially in the staggered needle variety of such machines.

In cut pile tufting machines an oscillating knife cooperates with an oscillating looper to cut the loop of yarn that has been seized by the looper from a corresponding needle. Until recently the prior art knife blocks were limited to mounting one or two knives only. However, the current trend in cut pile carpeting has been increasingly directed toward fine guage fabric, this being one tenth gauge and smaller. Since the gauge of a pile fabric is determined by the spacing between adjacent gauge parts, i.e., the longitudinally adjacent needles, loopers and knives, for fine gauge fabrics, the spacing between a point on one knife to the corresponding point on an adjacent knife is 0.1 inch and smaller. Thus, the thickness of the web of a knife block carrying two knives in a 1/10 gauge machine must be 0.1 inch minus the thickness of one knife and the maximum overall thickness of the block would be 0.2 inch, which then is the maximum diameter of the shaft supporting the block in the knife bar. This is considered to be too small to support the load on the block. Therefore, knife blocks carrying more than two blades have been proposed which allows use of a larger diameter support shafts.

Fine gauge cut pile tufting machines can be manufactured having all the needles in a single longitudinal row or the needles may be placed in parallel rows laterally spaced and staggered one from the other. The later approach is advantageous when the thicker yarns are to be tufted. A machine of this type is illustrated in Crumbliss et al U.S. Pat. No. 3,913,505. In the machine illustrated in that patent the throats of the loopers and therefore the knives which cut at the throats are all respectively aligned. In other machines of the staggered needle type the throats of alternate loopers are staggered to the same extent as the needles thus, since the knives cut at the respective throats of the loopers, adjacent knives are offset by the amount of the stagger. See, for example Card U.S. Pat. No. 3,084,644.

A manufacturing problem arises when a knife block carrying more than two knives and particularly four knives, is utilized with a staggered needle arrangement having loopers with alternate throats offset and where the front to rear stagger is greater than a minimal amount. With a conventional four bladed block having aligned knives, each knife receiving channel is a slot cut with a milling cutter. Since the width of the knives are standard at approximately ½ inch, the mill cutter diameter is approximately ½ inch and the shank diameter of the cutter tool is approximately ⅜ inch. However, when the front to back needle stagger is approximately ¼ inch, the inner slots of a four knife block, i.e., the slots adjacent the web, cannot be milled because the maximum depth of staggered cut allowed by the shank acting against the metal about the outer slots is approximately 1/16 inch, the difference between the cutter radius and the shank radius. In fact, with a ¼ inch knife stagger, a one half inch cutter cannot be used at all because there would be no space for a shank of any diameter. If a knife of a larger width were to be used the knife would be too stiff for use with the fine gauge looper.

SUMMARY OF THE INVENTION

The present invention overcomes these problems by providing a knife block and a method of manufacturing a knife block having a pair of slotted inserts positioned and secured on opposite sides of the central web of a block body. The inserts have longitudinal grooves formed on opposite sides, one groove together with the central web of the block body defining an inner knife receiving channel, and the other groove being undercut to define an outer knife receiving channel. The grooves in each insert are laterally staggered with respect to each other by the amount of the knife stagger required. The block body is formed with cavities on opposite sides of the web to receive the inserts securely. Preferably inner surfaces of the flanges of the block are inclined outwardly from the web wall surfaces away from the outer surfaces of the respective flanges and the inserts have cooperating surfaces to form a dovetail connection therebetween. The insert on each side of the web is thus a duplicate of the other.

Consequently, it is a primary object of the present invention to provide a knife block for carrying at least four knives, alternate knives being laterally offset relative to the adjacent knives.

Another object of the present invention is to provide a knife block having a body member with a central web, and an insert securely positioned adjacent each longitudinal face of the web, each insert having a pair of laterally offset grooves, one groove forming with the adjacent face of the web a knife receiving channel, and the other groove being undercut to form a second knife receiving channel.

A further object of this invention is the provision of a method for manufacturing cut pile tufting machine knife blocks having four knife receiving channels, the adjacent channels being laterally offset from each other.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE INVENTION

Figure 1:
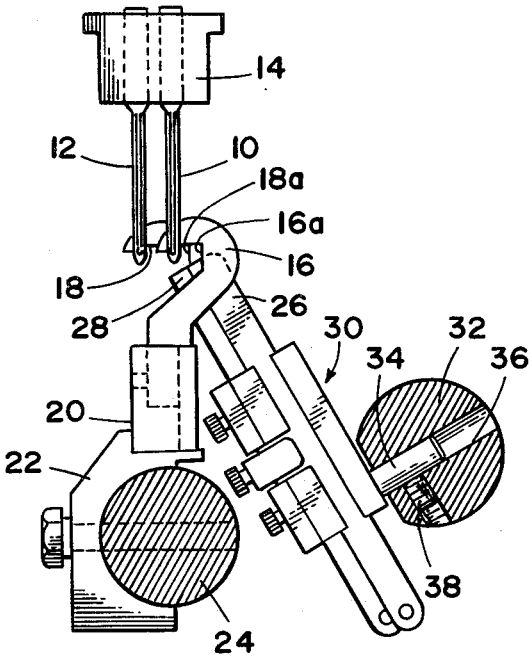
FIG. 1 is a side sectional elevational view taken through a portion of a staggered needle cut pile tufting machine, and disclosing a knife block constructed in accordance with the present invention.

Referring to FIG. 1, the relevant portions of a staggered needle cut pile tufting machine are illustrated including a pair of needles 10 and 12 longitudinally spaced apart and laterally offset one from the other as illustrated in the aforesaid Crumbliss et al patent. The needles are supported in a needle bar 14 and reciprocated in a conventional manner to cooperate with respective loopers 16 and 18. The loopers are supported in a looper bar 20 carried by a looper bar support block 22 suitably secured to a rock shaft 24 which oscillates to drive the loopers back and forth into cooperation with the respective needles. Loops of yarn seized by the loopers move toward the throats 16*a*, 18*a* at the closed ends of the loopers and are cut by respective knives 26 and 28 carried in knife blocks generally indicated at 30 to form cut pile fabric. The knife blocks are supported in a rock shaft 32 by means of support shafts or studs 34 integral with each block and received within a bore 36 in the shaft 32 and secured by a set screw 38 or the like. Thus, the knives are oscillated by the rock shaft 32 back and forth into cutting engagement with the yarn on the respective loopers.

Figure 2:
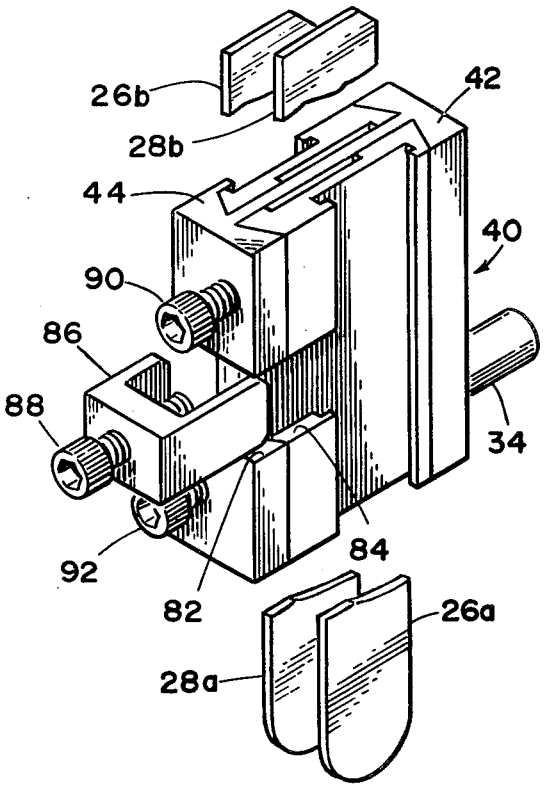
FIG. 2 is a perspective view of a knife block constructed in accordance with the present invention and illustrating four such knives partly broken away.
Figure 3:
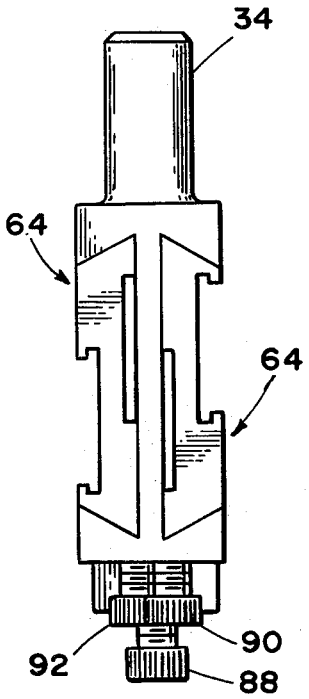
FIG. 3 is a top plan view of the knife block illustrated in FIG. 2 with the knives in section.
Figure 4:
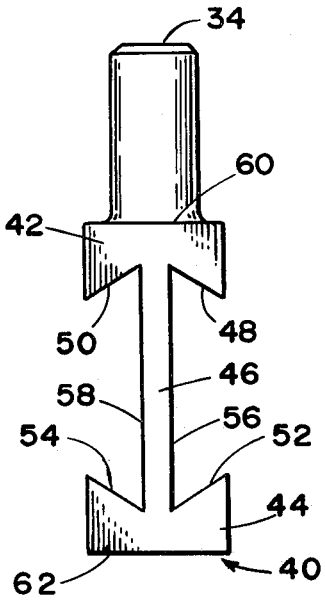
FIG. 4 is a top plan view of the knife block body member.
Figure 5:
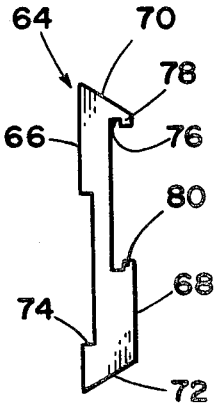
FIG. 5 is a top plan view of one of the inserts.

In the illustrated arrangement the throats 16*a* and 18*a* of the respective alternate loopers 16 and 18 are offset or staggered to the same extent as the needles 10 and 12, and the respective corresponding knives 26, 28 are likewise offset so that cutting occurs at the looper throats. As pointed out above, in a fine gauge tufting machine, the longitudinal spacing between equivalent points on adjacent needles, loopers and knives is no more than 0.1 inch. Thus, the knife block 30, as illustrated in FIG. 2 carries four identical knives 26*a*, 28*a*, 26*b*, 28*b*, thereby allowing the stud shaft 34 to be of sufficient strength.

The knife block 30 comprises a body member 40 having a pair of longitudinally extending flanges 42 and 44 connected together by a longitudinally extending laterally central web 46. The inner surface 48 and 50 of the flange 42 and the inner surface 52 and 54 of the flange 44 are inclined outwardly from the respective faces 56 and 58 of the web and inwardly away from the outer surface 60, 62 of the respective flanges 42, 44. Thus, the plane of the surfaces 48 and 52 converge to a line on the common side of the web with face 56, and the plane of the surfaces 50 and 54 converge to a line on the common side of the web with face 58. The arrangement is such that a pair of dovetail shaped cavities are formed by the surfaces 48, 56 and 52 and the surfaces 50, 58 and 54 respectively. The stud shaft 34 is formed integral with the body member and extends from one of the flanges, to wit, flange 42.

Each insert 64 comprises an elongated member having a trapezodial cross sectional configuration identical to that of the dovetail shaped cavities in the body member, and are sized to provide a substantially tight fit. Thus, each insert 64 is substantially the same length as the body member 40 and has a web engaging face 66 and a narrower exterior face 68 connected together by a pair of lateral inclined surfaces 70 and 72. Cut into the face 66 of the inserts is a first substantially rectangular groove 74 of a width substantially equal to the width of the knives and of a depth substantially equal to the thickness of the knives. The groove 74, when the insert is positioned in a dovetail cavity in the body member 40, defines with the adjacent face 56 or 58 of the web, an inner knife receiving channel. A second substantially rectangular groove 76 is cut into the face 68 undercut from the surface thereof so as to leave a pair of lips 78 and 80 and defines an outer knife receiving channel. The width of the groove 76 is also substantially equal to that of the knives and the depth substantially equal to the thickness of the knives. The groove 76 is laterally offset from the groove 74 by the amount of the lateral offset or stagger required by the knives as explained above. The thickness of the lips 78 and 80 is such that when two knife blocks are mounted in abutting relation adjacent each other the distance from a point on one knife in an outer groove 76 to a corresponding point on an adjacent knife in the adjacent block is substantially equal to the gauge of the machine. Thus, the thickness of each lip is substantially equal to half the difference between the gauge and the thickness of a knife. Similarly, the thickness of the web 46 is substantially equal to the difference between the gauge and the knife thickness, so that the thickness of the lips 78 and 80 is half the thickness of the web 46 of the body member 40.

It is thus seen that each dovetail cavity in the block body 40 may slidably receive one of the inserts and a knife can be received in each channel. To secure the knives in the channels a slot 82 is cut into each outer lateral face of the body member flange 62 and a second slot 84, being a continuation of the slot 82, is cut into the adjacent face of the insert, and a U-shaped clamp member 86 bridges across the flange 44 with its legs in the slots; the slot and the leg on one side being longer than that on the other side by the stagger or offset. The member 86 is secured by means of a screw 88 to the flange and the ends of the legs act against the edge of the respective knives 26*a* and 26*b*. The knives 28*a* and 28*b* are secured by screws 90 and 92, the screw 92 obviously being longer by the amount of the offset or stagger. The clamp 86 and the screws 90 and 92 also aid in securely locking the insert in the block.

The construction allows a four bladed knife block to be built for a staggered knife arrangement. A multiplicity of knife blocks so constructed may extend in substantially abutting relation across the width of a tufting machine so that each looper cooperates with a knife.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. A knife block for a tufting machine comprising an elongated body member having a pair of longitudinally extending spaced flange portions, said flange portions being connected together by a longitudinally entending substantially centrally disposed web having a pair of laterally spaced faces, each said face with the adjacent inner faces of the flange defining a cavity on each side of the web, a pair of longitudinally extending inserts each having a configuration adopted to be slidably received in each cavity and having first and second laterally spaced faces, each insert having a first groove formed in the first face adapted to abut said faces of the web, said groove and the face of the web together defining a first knife receiving channel, a second groove formed in each insert substantially parallel to the first groove undercut from the second face to define a second knife receiving channel, and locking means for securing each insert in the respective cavity.

2. A knife block as recited in claim 1 wherein said first groove is offset from said second groove with respect to said flanges.

3. A knife block as recited in claim 1 wherein said locking means includes a dovetail connection between said body member flanges and said inserts.

4. A knife block as recited in claim 3 wherein each dovetail connection is defined by the inner faces of said flanges and the adjacent face of said web and by the cooperating faces of the insert.

5. A knife block as recited in claim 4 wherein said first groove is offset from said second groove with respect to said flanges.

6. A knife block as recited in claim 5 wherein said locking means further includes a clamping member secured to one flange having a pair of legs, each leg extending into the second knife receiving channel, and a pair of clamping members each extending into a respective one of said first channels.

* * * * *